US006402710B1

(12) United States Patent
Hsu

(10) Patent No.: US 6,402,710 B1
(45) Date of Patent: Jun. 11, 2002

(54) MOTOR-DRIVEN MASSAGING BAR WITH SWIVEL BALLS

(76) Inventor: Yu Hsu, 2F, 17 Lane 39, Chi Lung Road, Sec. 2, Taipei (TW)

( * ) Notice: Subject to any disclaimer, the term of this patent is extended or adjusted under 35 U.S.C. 154(b) by 0 days.

(21) Appl. No.: 09/813,837

(22) Filed: Mar. 22, 2001

(51) Int. Cl.[7] ..... A61H 15/00

(52) U.S. Cl. ..... 601/113; 601/112; 601/122; 601/126; 601/127; 601/131

(58) Field of Search ..... 601/112, 113, 601/119–122, 126–131, 84, 85, 97, 101–103, 67–70, 72

(56) References Cited

U.S. PATENT DOCUMENTS 2,156,839 A * 5/1939 Buffalow ..... 128/49
4,326,508 A * 4/1982 Stauffer ..... 128/57
5,711,758 A * 1/1998 Tseng ..... 601/127
6,149,611 A * 11/2000 Chen ..... 601/22

* cited by examiner

*Primary Examiner*—Justine R. Yu
(74) *Attorney, Agent, or Firm*—Rosenberg, Klein & Lee

(57) ABSTRACT

A motor-driven massaging bar is constructed to include a controller, a DC motor connected to and controlled by the controller, a shell fastened to the controller to hold the DC motor on the inside, and a massaging unit mounted on one end of the shell and coupled to the output shaft of the DC motor, the massaging unit including a shaft coupled to the output shaft of the DC motor, a ball holder, a bottom ball table and a top ball table fastened together to hold swivel balls around the periphery for massaging and supported on rolling steel balls at the ball holder, and a conical cap covered on the top ball table.

1 Claim, 4 Drawing Sheets

MOTOR-DRIVEN MASSAGING BAR WITH SWIVEL BALLS

BACKGROUND OF THE INVENTION

The present invention relates to handy massaging apparatus and, more particularly, to a motor-driven massaging bar with swivel balls.

A variety of massaging apparatus have been disclosed for massing different parts of the body, and have appeared on the market. These conventional massaging apparatus are commonly heavy, complicated, and expensive.

SUMMARY OF THE INVENTION

It is one object of the present invention to provide a motor-driven massaging bar, which is handy and compact. It is another object of the present invention to provide a motor-driven massaging bar, which is smooth and practical in use. To achieve these and other objects of the present invention, a motor-driven massaging bar is provided comprised of a controller, a DC motor connected to and controlled by the controller, a shell fastened to the controller to hold the DC motor on the inside, and a massaging unit mounted on one end of the shell and coupled to the output shaft of the DC motor. The massaging unit comprises a shaft coupled to the output shaft of the DC motor, a ball holder, a bottom ball table and a top ball table fastened together fastened together to hold swivel balls around the periphery for massaging and supported on rolling steel balls at the ball holder, and a conical cap covered on the top ball table.

DETAILED DESCRIPTION OF THE PREFERRED EMBODIMENT

Figure 1:
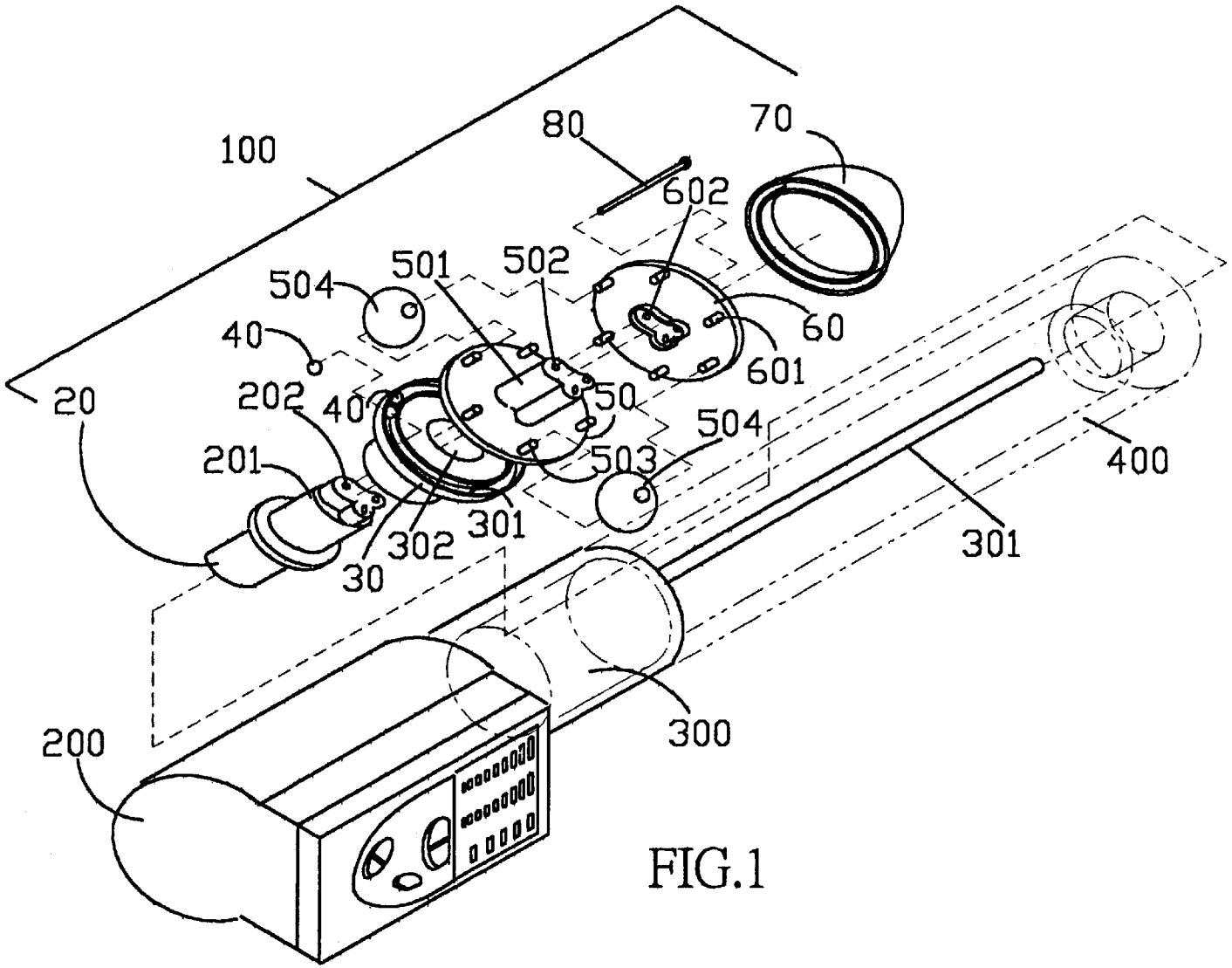
FIG. 1 is an exploded view of a motor-driven massaging bar according to the present invention.
Figure 2:
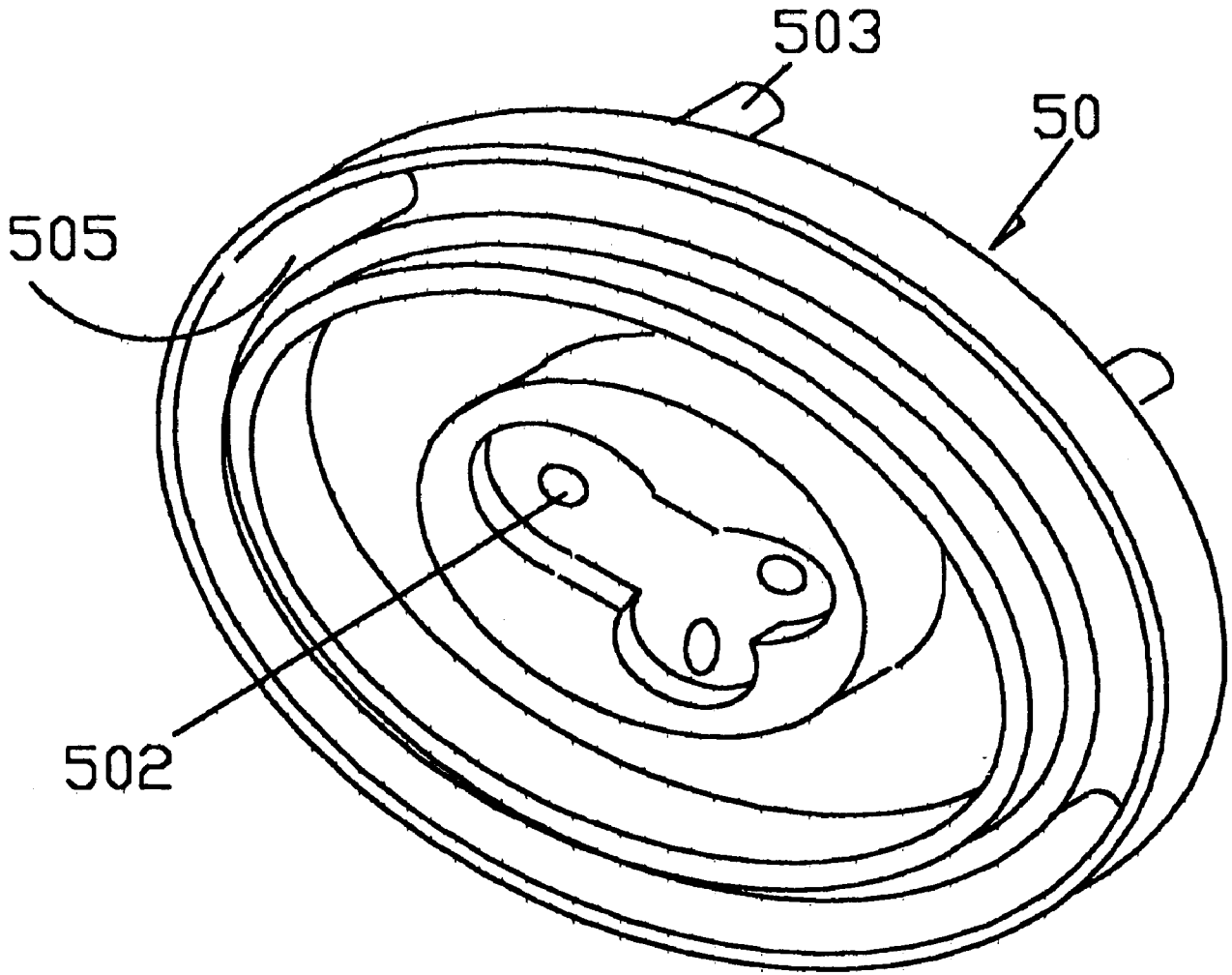
FIG. 2 is an oblique bottom elevation of the rotary plate for the motor-driven massaging bar according to the present invention.
Figure 3:
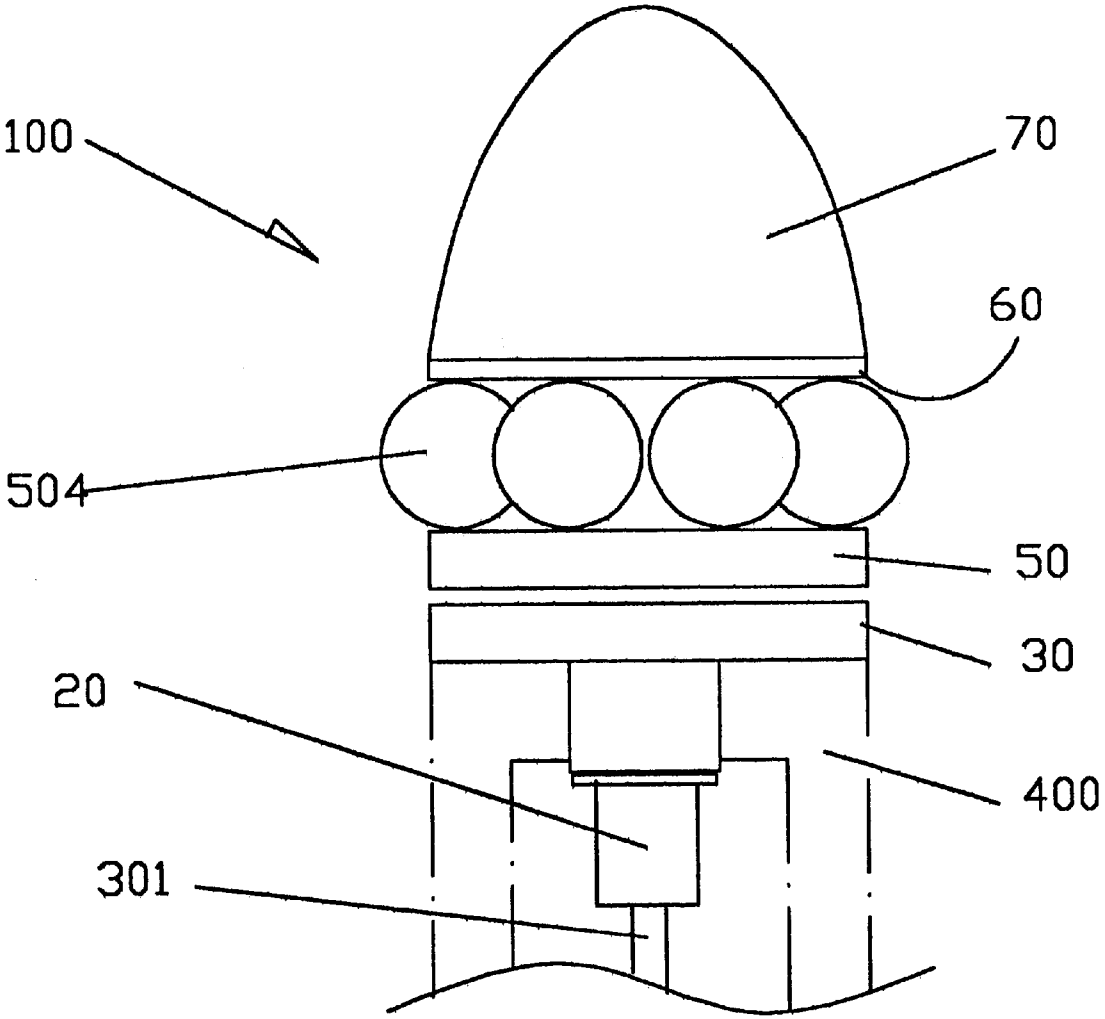
FIG. 3 is a side plain view of the upper part of the motor-driven massaging bar according to the present invention.

Referring to FIGS. from 1 through 3, a motor-driven massaging bar is shown comprising a controller 200, a DC motor 300 connected to the controller 200, a shell 400 fastened to the controller 200 to hold the DC motor 300 on the inside, and a massaging unit 100 mounted on one end of the shell 400 and coupled to the output shaft 301 of the DC. motor 300. The massaging unit 100 comprises a shaft member 20 coupled to the output shaft 301 of the DC motor 300, a ball holder 30, a plurality of steel balls 40, a plurality of swivel balls 504, a bottom ball table 50, a top ball table 60, and a conical cap 70. The shaft member 20 has a plurality of screw holes 202 axially disposed at the front end 201 thereof. The ball holder 30 comprises an axially extended center through hole 302, which receives the front end 201 of the shaft 20, and an annular ball groove 301 disposed at the top sidewall thereof around the center through hole 302. The bottom ball table 50 is covered on the ball holder 30, comprising an upright post 501 extended from the center of the top sidewall thereof, a plurality of through holes 502 axially extended through the upright post 501, an annular ball groove 505 disposed at the bottom sidewall thereof, and a plurality of upright pins 503 extended from the top sidewall around the border area. The steel balls 40 are respectively moved in the annular groove 301 of the ball holder 30 and the annular ball groove 505 of the bottom ball table 50. The top ball table 60 comprises a plurality of countersunk holes 602 respectively connected to the. through holes 502 of the bottom ball table 50 and the screw holes 202 of the shaft 20 by a respective screw bolt 80, and a plurality of bottom pins 601 respectively extended from the bottom sidewall thereof and aimed at the upright pins 503 of the bottom ball table 50. The swivel balls 504 are respectively rotatably mounted on the upright pins 503 of the bottom ball table 50 and the bottom pins 601 of the top ball table 60. The conical cap 70 is covered on the top ball table 60.

Figure 4:
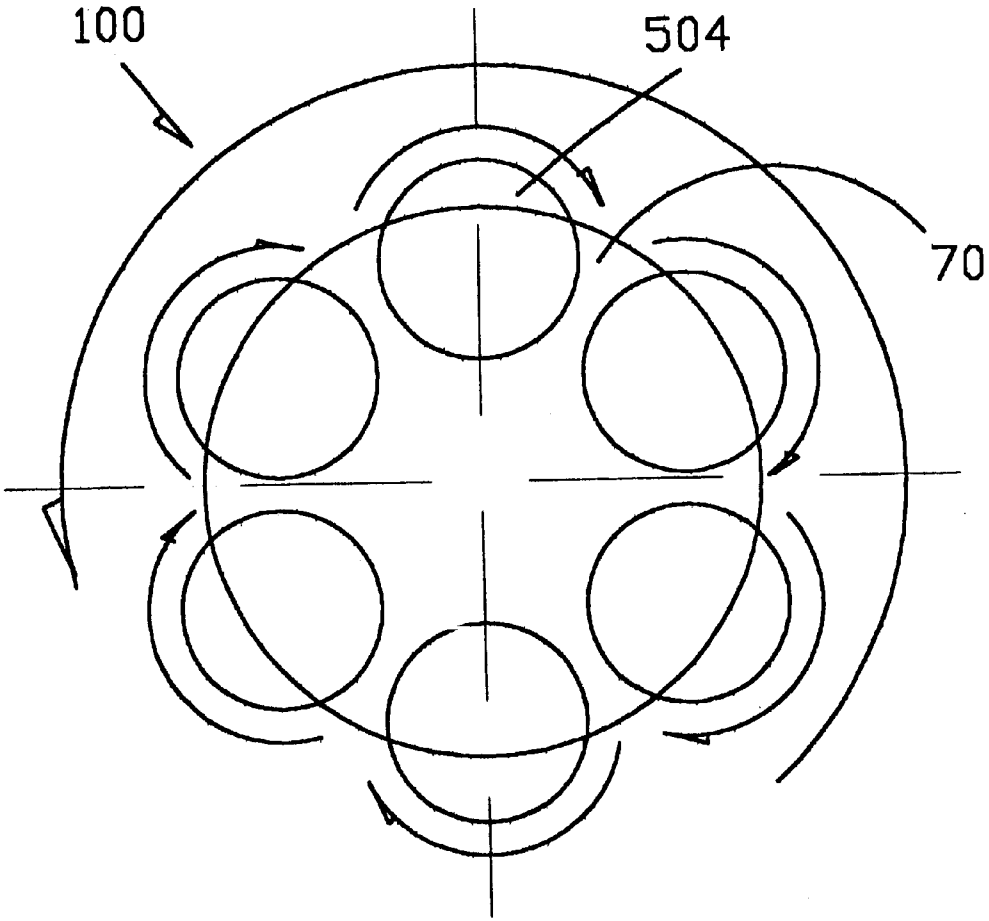
FIG. 4 is a schematic drawing showing the steel balls and the swivel balls rotated in reversed directions according to the present invention.

Referring to FIG. 4, when attaching the swivel balls 504 to a part of the body to be massaged and operating the controller 200 to rotate the DC motor 300, the bottom ball table 50 and the top ball table 60 with the conical cap 70 are rotated with the shaft 20 in one direction, and the swivel balls 504 are rotated in the reversed direction.

A prototype of motor-driven massaging bar has been constructed with the features of the annexed drawings. The motor-driven massaging bar functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A motor-driven massaging bar comprising:

a controller;

a DC motor connected to and controlled by said controller, said DC motor having an output shaft;

a shell fastened to said controller to hold said DC motor on the inside; and a massaging unit mounted on one end of said shell and coupled to the output shaft of said DC motor;

wherein said massaging unit comprises a shaft member coupled to the output shaft of said DC motor, a ball holder coupled to the shaft of said massaging unit, said ball holder comprising an axially extended center through hole, which receives a part of said shaft, and an annular ball groove disposed at a top sidewall thereof, a bottom ball table covered on said ball holder, said bottom ball table comprising an upright post extended from the center of a top sidewall thereof, an annular ball groove disposed at a bottom sidewall thereof, a plurality of through holes axially extended through said upright post, and a plurality of upright pins respectively extended from the top sidewall around the border thereof, a plurality of steel balls moved in the annular ball groove of said ball holder and the annular ball groove of said bottom ball table, a top ball table fastened to the upright post of said bottom ball table, said top ball table comprising a plurality of countersunk holes respectively fastened to the through holes of said bottom ball table and screw holes of the shaft of said massaging unit by a respective screw bolt, and a plurality of bottom pins respectively extended from a bottom sidewall thereof and aimed at the upright pins of said bottom ball table, a plurality of swivel balls respectively rotatably mounted on the upright pins of said bottom ball table and the bottom pins of said top ball table, and a conical cap covered on said top ball table.

* * * * *